United States Patent [19]

Kaye et al.

[11] Patent Number: 4,524,534

[45] Date of Patent: Jun. 25, 1985

[54] POSITION ACTUATED ILLUMINATED GUNSIGHT

[75] Inventors: Gordon E. Kaye, Garrison; Joseph A. Agnello, Jr., Peekskill, both of N.Y.

[73] Assignee: Univention Incorporated, Garrison, N.Y.

[21] Appl. No.: 451,476

[22] Filed: Dec. 20, 1982

[51] Int. Cl.[3] ..... F41G 1/34

[52] U.S. Cl. ..... 42/1 S; 33/241; 362/802; 362/110; 362/800

[58] Field of Search ..... 362/110, 111, 112, 800, 362/802; 42/1 S, 1 A; 33/241

[56] References Cited

U.S. PATENT DOCUMENTS

| | | | |
|---|---|---|---|
| 497,540 | 5/1893 | DiGiovanni | 33/241 |
| 3,833,799 | 9/1974 | Audet | 362/800 X |
| 3,834,035 | 9/1974 | Merrill | 42/1 S X |

FOREIGN PATENT DOCUMENTS

| | | | |
|---|---|---|---|
| 2481435 | 10/1981 | France | 42/1 S |

*Primary Examiner*—Stephen C. Bentley
*Assistant Examiner*—John S. Maples
*Attorney, Agent, or Firm*—Israel Nissenbaum

[57] ABSTRACT

An illuminated gunsight adapted to be fixedly engageable with a firearm having existing sighting means, said gunsight comprising illumination means which are moveable relative to said existing sighting means with the illumination means being electrically actuated by movement thereof into proper aiming position and relationship with said existing sighting means. Said illumination means is deactivated by movement thereof from said proper aiming position without removal of the illuminated gunsight from the firearm.

1 Claim, 5 Drawing Figures

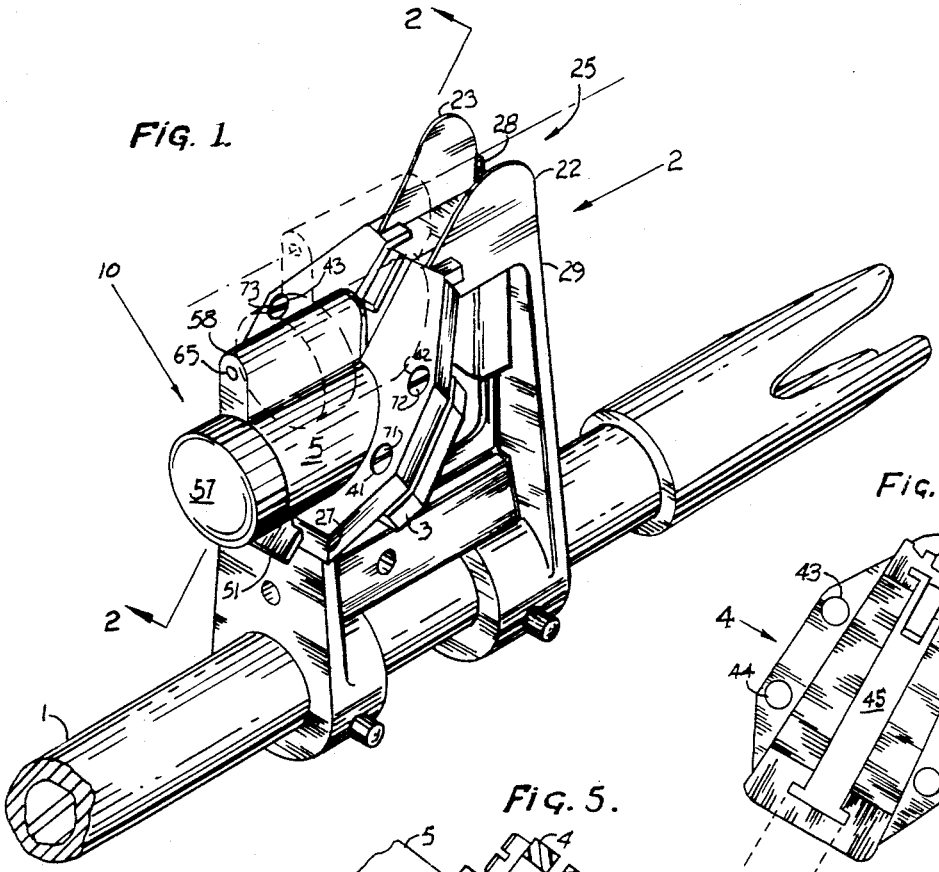
Fig. 1.
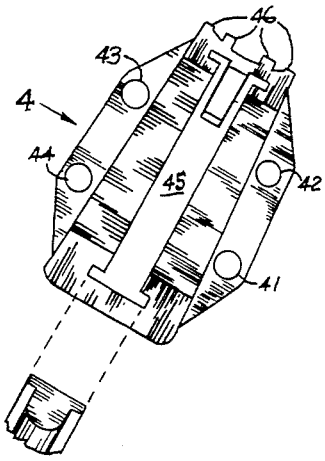
Fig. 4.
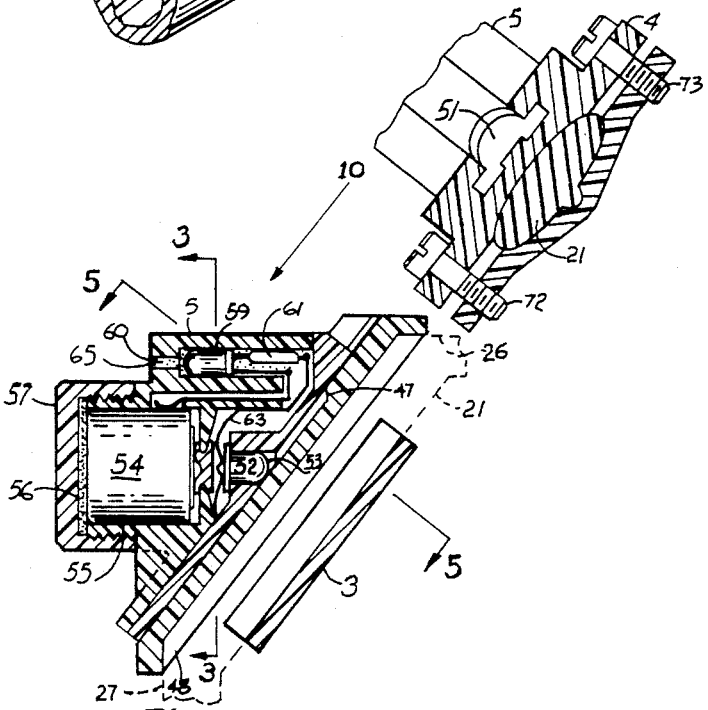
Fig. 5.
Fig. 2.
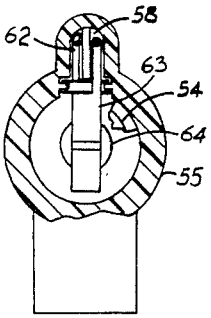
Fig. 3.

POSITION ACTUATED ILLUMINATED GUNSIGHT

This invention relates to illuminated gunsights and particularly to electrically operated gunsights utilized for providing a pinpoint of light in illuminating the end of a firearm or other sighting means of the firearm for aiming under low light level conditions.

Electrically operated illuminated gunsights such as described in U.S. Pat. Nos. 3,914,873 and 3,994,072 have either been physically incorporated into the firearm such as by permanent positioning thereon with internal (relative to the firearm) wiring to an actuating switch also integrated with the firearm or, alternatively, such illuminated gunsights have been of an "add-on" nature and have generally been affixed to the barrel of the firearm. On some firearms, however, because of the configuration of the existing sighting means, such as those which provide a framing sight for a target, it is highly desirable that such illuminated gunsights be easily removable for use of the firearm during daylight hours or under conditions of sufficient light levels. Such removal is desirable since the illumination itself and the body or bulk of the illuminated gunsight may in fact be a hindrance for proper aiming and sighting under proper lighting conditions. In order to effect such removal, "add-on" illuminated gunsights were generally required to be totally disengaged from the firearm with built-in illuminated gunsights not even providing for such option if desired.

In addition to the necessity for total removal of the illuminated gunsights, the actual usage of such gunsights provided some difficulties since the "add-on" gunsights were generally cumbersome and obtrusive. Furthermore, in some applications, such as with an M-16 rifle having a target framing sighting means, such prior art illuminated gunsights could not be readily or effectively utilized therewith. Firearms such as the M-16 rifle utilize extending elevated sights thereby rendering ineffectual prior art illuminated gunsights which were generally adapted to be affixed to the barrel of the firearm.

It is an object of the present invention to provide an illuminated gunsight for fixed engagement with a firearm wherein the normal sighting means of the firearm may be utilized when desired without impedance from the gunsight and without the necessity for the removal thereof from the firearm.

It is a further object of the present invention to provide such illuminated gunsight whereby it is operably mounted upon the existing sight of a firearm.

These and other objects, features and advantages of the present invention will become more evident from the following discussion as well as the drawings in which:

FIG. 1 is an isometric view of the illuminated gunsight of the present invention positioned on the sight of an M-16 rifle;

FIG. 2 is a section view taken along line 2—2 of FIG. 1;

FIG. 3 is a partial section view taken along line 3—3 of FIG. 2;

FIG. 4 is a plan separated view of the co-fitting sighting element and the sliding platform element into which it is moveably mounted; and FIG. 5 is a partial section view taken along line 5—5 of FIG. 2.

Generally the present invention comprises an illuminated gunsight for a firearm which aids in the visual perception of the sighting means of the firearm under conditions of low ambient light. Such illuminated gunsight is useful in limning the target itself relative to the existing firearm sight for enhanced aiming under such low light conditions.

The illuminated gunsight of the present invention comprises moveable electrically powered illumination means, positioning means and anchoring means for affixing the gunsight to the firearm itself, or to an existing sight on said firearm such as the elevated ramp sight utilized with M-16 rifles. Such anchoring means preferably comprises one or more members conformed to the shape of the firearm or the sight thereof, where the gunsight is to be positioned, said member or members being held by a frictional grip with said firearm or sight.

The positioning means locate the gunsight on the firearm or an existing sight for alignment of said illumination means with the existing firearm sighting means. Such positioning means also preferably helps prevent movement of the gunsight on the firearm in the direction of movement of the illumination means.

The illumination means is electrically powered and is moveable in a restricted plane relative to the sighting means and the gunsight anchored to said firearm. An illuminated point of reference is lit when desired, by such movement to enable the shooter to readily and properly align the existing sighting means of the firearm with a target under low light conditions. The moveable illumination means is manually moved into position for such proper aiming alignment and removed from such position, when not desired, with such movement being effected without removal of the gunsight from its fixed position on the firearm.

The illuminated gunsight further comprises position actuating means for electrically powering said illumination means when the illumination means is in position for sighting therewith. Under conditions of sufficient light for sighting such as in daylight, when the illumination and the illumination means are unecessary, or in fact a hindrance for proper sighting, means are provided for deactivation of the illumination and the removal of the illumination means from the sighting position, without the necessity for removal of the gunsight from the firearm.

The illumination means, such as a light emitting diode (LED) is powered by a power supply such as an electric cell or battery (hereinafter referred to as battery) generally contained within said gunsight. The positioning means causes the completion of an electrical circuit between the battery and the LED when the LED is in sighting alignment for proper aiming at low light levels. For example, the position actuating means may comprise a moveable member which forces an electrical connector into contact with the battery for completion of an electrical circuit. Alternatively, the illumination means and/or connections thereof may be moved into direct engagement with the battery during the movement required to properly position said illuminating means.

In a preferred embodiment of the present invention, the position activated illuminated gunsight is adapted for use with an M-16 rifle having a substantially elevated ramped sighting member with such illuminated gunsight being fixedly positioned and seated on said existing M-16 sight, and being position activated by movement of the illumination means relative to said existing sight.

The illuminated gunsight, adapted for use with the M-16 rifle, comprises three elements, a clamping base element for anchoring the gunsight on the M-16 sight, a slide platform fixed into position on said M-16 sight by engagement with said clamping element, and an illumination member with contained power supply, which is moveably slideable in relation to said slide platform and said existing sight.

The clamping base element and the slide platform sandwich the ramp of an M-16 rifle sight therebetween and are fixedly held in position by holding means such as connecting screws or bolts. The slide platform overlaps and fixedly engages the ends of the ramp portion of an M-16 rifle sight for positive non-moveable engagement therewith thereby setting a frame of reference for positioning said gunsight for movement of the illumination sight member into proper illumination position with the existing sight with the simultaneous electrical actuation caused by such positioning. Sliding of the illumination member into sighting position causes completion of an electrical circuit with a contained power supply to activate the illumination thereof.

With specific reference to the drawings, FIGS. 1, 2, and 5 depict the illuminated gunsight 10 of the present invention positioned on a ramped sight 2 located on barrel 1 of an M-16 rifle. The standard M-16 rifle sight 2 comprises an open right triangle shaped member 29 fixed at the base thereof to said rifle barrel 1. The ramp section 21 of said triangle member 29 faces the shooter and terminates, at its upper end with wing sections 22 and 23 which serve to frame a target within area 25 and into alignment with target pin 28 for proper sighting and aiming during shooting. Illuminated gunsight 10 is positioned on said ramp section 21 with sliding illumination member 5 being moveable as shown by the dotted lines such that the illuminating means, light emitting diode (LED) 59, is moved into proper alignment with said target framing area 25 and target pin 28 for low light level shooting. Slide platform 4, and clamping base plate 3, lock the gunsight 10 into position by sandwiching ramp section 21 therebetween with holding screws 71–74. Said screws pass through apertures 41–44 respectively in slide platform 4, and are engaged in aligned, adjacent threaded holes in clamping base plate 3. As is more evident in FIG. 5, both the base plate 3 and slide platform 4, are shaped to specifically accommodate ramp section 21 therebetween to provide a positive frictional grip.

Slide platform 4, as seen in FIGS. 1, 2 and 4 has finger sections 46 to fixedly engage wing sections 22 and 23 of sight 2 for effecting a positive stop in the upward direction for said slide platform 4. Finger sections 46 rest upon upper platform 26 of sight 2 thereby fixedly providing a positive frame of reference for movement of illumination member 5 into proper sighting and simultaneous actuating position. At its lower periphery, slide platform 4 engages lower wall 27 of sight 2. Skirt section 48 fits onto ramp 21 to complete the fixed engagement of slide platform 4 relative to ramp section 21 and sight 2 thereby preventing movement of the slide platform 4 during the positioning movement of the illumination member 5.

Slide platform 4 contains a "T" slot 45 as shown in FIG. 4 which is adapted to be engaged with "T" shaped member 51 of the sliding illumination member 5. Such engagement permits relative movement of illumination member 5 and slide platform 4 for both positioning of the illuminating diode 59 for proper low light aiming and the simultaneous electrical actuation thereof by such movement.

The electrical circuitry, illumination means and actuating means for the illuminated gunsight 10 are contained within sliding illumination member 5. As shown in FIG. 2, light emitting diode (LED) 59 is contained within chamber 58 such that light from the LED is visible through opening 60. Reduction of glare from the LED 59 is effected by connecting the LED 59 to a voltage dropping resistor 61 and by narrowing aperture or opening 60. The LED 59 and resistor 61, which may be integrated with the LED, are encapsulated within an encapsulating material such as a transparent epoxy 65 which protects the LED 59 and resistor 61 from both shock and moisture while permitting light from the LED to be seen through aperture 60 when the LED 59 is in alignment with target sighting pin 28. LED 59 is electrically powered by battery 54 which is contained within battery compartment 55 and sealed therein by threaded cap 57 and watertight resilient gasket 56. Terminal lead tab 62 electrically connects LED 59 to a terminal of battery 54. During activation of the LED 59, lead tab 63, made of resilient leaf spring material, serves to complete the circuit for powering LED 59 for illumination via metal contact to rivet 64 which is in turn in contact with the other terminal of battery 54. Lead tab 63 is normally, however, resiliently biased against making contact with metal rivet 64 and is in spring contact with activation pin 52 seated in aperture 53 in the base of illumination member 5.

Electrical activation of LED 59, by means of positioning movement, is effected by the upward sliding movement of "T" shaped sliding member 51, of illumination member 5, within accomodating "T" slot 45 in slide platform 4 to the position shown in dotted lines in FIG. 1. In such position, pin 52 will have moved up ramp 47 in slide platform 4 whereby such pin 52 is thereby moved toward battery 54 thereby causing tab 63 to electrically engage rivet 64 and battery 54 to complete the circuit thereby lighting up LED 59. Thus only when the LED 59 is in proper sighting position in alignment with target sighting pin 28 is such LED 59 illuminated. Deactivation of LED 59 is effected by downward sliding movement of illumination member 5, with the riding down of pin 52 off ramp 47 with the consequent release and spring movement of tab 63 from electrical contact with rivet 64 and battery 54. Thus, when not desired, illumination is shut off and the illumination member is removed from the sighting area without removal of the entire gunsight.

The material comprising the illuminated gunsight of the present invention should be resistant to shock, vibration, humidity and varying temperature changes. An exemplary material suitable for such usage is polycarbonate. Similarly, the illumination means is a shock resistant diode which is also preferred over other lighting means such as incandescent bulbs because of its low power consumption. Nevertheless other sighting means if properly protected may be utilized in place of the diode.

The battery is preferably a lithium battery because of its high capacity in a limited space, long storage life, and its good performance over a wide temperature range.

It is understood that the above description and drawings are illustrative of the present invention and are not to be construed as limitations on the present invention.

Thus, depending upon the configuration and operation of particular firearms, various modifications of the position actuated illuminated gunsight of the present invention are possible. For example, the illuminated gunsight may be affixed to the barrel of a firearm with the illumination means being rotatably moveable about the barrel with activation being effected by cam action. Other changes may similarly be made such as in the configuration and means for providing the activation movement and the activation without departing from the scope of the present invention as defined by the following claims.

We claim:

1. An illuminated gunsight for an M-16 rifle having an elevated ramp sight terminating at its upper end in a platform with wing sections extending upwardly from said platform which platform and wing sections form a target framing area, said sight further comprising a ramp section, said gunsight comprising a peripheral skirt adapted for seating engagement with the ramp section of said sight, and extension elements for engagement with said wing sections, said gunsight further comprising anchoring means for fixed engagement of said gunsight with said ramp section, said gunsight further comprising a moveable illumination member having a light emitting diode and an electric battery, having positive and negative terminals, contained therein, with electrical connections between said light emitting diode and the terminals of said battery, said light emitting diode being visible to the rear of said firearm, said illumination member including said light emitting diode being moveable in a direction up and down said ramp into and out of aligment with said target framing area, means electrically disconnecting one of said electrical connections from said battery when said illumination member with light emitting diode is moved down said ramp and out of alignment with said target framing area without removal of said gunsight from the rifle, and wherein said gunsight further comprises a moveable activation member which forces said disconnected electrical contact into electrical contact with said battery when said illumination member is moved up said ramp and into alignment with said target framing area, whereby said contained light emitting diode is electrically activated for sighting.

* * * * *